United States Patent [19]

Pechacek

[11] 4,418,560

[45] Dec. 6, 1983

[54] SHELL LAYER WRAPPING MACHINE AND METHOD OF POSITIONING VESSEL SECTIONS OF A MULTI-LAYER VESSEL

[75] Inventor: Raymond E. Pechacek, Houston, Tex.

[73] Assignee: Hahn & Clay, Houston, Tex.

[21] Appl. No.: 262,293

[22] Filed: May 11, 1981

[51] Int. Cl.[3] ..... B21D 11/02; B21D 31/00; B23D 11/02

[52] U.S. Cl. ..... 72/296; 72/292; 29/446

[58] Field of Search ..... 72/292, 296; 29/446, 29/455 R, 455 LM; 24/279, 280, 281, 282, 283, 284; 269/130, 131

[56] References Cited

U.S. PATENT DOCUMENTS

| | | | |
|---|---|---|---|
| 2,480,369 | 8/1949 | Jasper . | |
| 2,674,966 | 4/1954 | Morris | 72/292 |
| 2,800,867 | 7/1957 | Smith | 72/292 |
| 3,414,950 | 12/1968 | Phariss | 24/280 |
| 4,053,971 | 10/1977 | Pechacek . | |

FOREIGN PATENT DOCUMENTS

| | | | |
|---|---|---|---|
| 591653 | 2/1978 | U.S.S.R. | 72/292 |
| 695740 | 11/1978 | U.S.S.R. | 72/292 |

*Primary Examiner*—Ervin M. Combs
*Assistant Examiner*—Steven Nichols
*Attorney, Agent, or Firm*—Pravel, Gambrell, Hewitt, Kirk & Kimball

[57] ABSTRACT

A shell layer wrapping machine and method of positioning vessel sections. The machine has a first and a second band portion which are drawn together by a tensioning means. The second band portion is placed over the vessel section to be added and hydraulic cylinders selectively draw the second band portion away from the vessel section so that radial pressure is applied to the vessel section from the center portion outwardly to the ends of the vessel section.

9 Claims, 6 Drawing Figures

SHELL LAYER WRAPPING MACHINE AND METHOD OF POSITIONING VESSEL SECTIONS OF A MULTI-LAYER VESSEL

TECHNICAL FIELD

The field of this invention is wrapping machines for use in manufacturing layered vessels.

PRIOR ART

Pressure vessels are often multi-layered. Such pressure vessels are formed by adding successive layers of vessel sections to the existing outer layer and welding the sections together to form a layer. In forming each layer, it is important that each section of the vessel layer being added is properly placed and held in position on the adjacent inner layer of the partially completed vessel when welded. Wrapping machines are used to hold vessel sections in the proper location.

One type of wrapping machine is disclosed in U.S. Pat. No. 4,053,971 by the present inventor which patent discloses an interlooped band mechanism having a tightening mechanism for moving the interlooped end portions of the band away from each other in order to apply tension to the band.

The force applied to the vessel section by this type of wrapping machine is tangential to the vessel surface resulting in undesirable frictional forces being applied between the vessel section and the adjacent inner vessel layer.

SUMMARY OF THE INVENTION

The present invention relates to a new and improved wrapping machine for use in construction of layered vessels having at least one layer formed of adjoining vessel sections wherein vessel sections are welded together along adjoining longitudinal edges by weldments. The wrapping machine has a band means adapted to encircle the layered vessel for positioning a vessel section on a layer therebelow. The band means has a first arcuate band portion and a second arcuate band portion which are joined by tensioning means which selectively applies a force to draw the first and second band portions together. A selective radial positioning means is attached to the second band portion to selectively move all or only part of the second band portion in pressure engagement with the vessel section in order to selectively press the vessel section into radially directed engagement with the vessel layer below.

In the method of the present invention, the vessel section is placed in position on the inner vessel layer. The first and second band portions are positioned about the layered vessel with the second band portion being positioned over the vessel section. The first and second band portions are tensioned with the band portions being positioned so that only a center portion of the second band portion engages a middle part of the vessel section in order to press the middle part of the vessel section radially against the inner vessel layer.

DESCRIPTION OF THE PREFERRED EMBODIMENT

Figure 2:
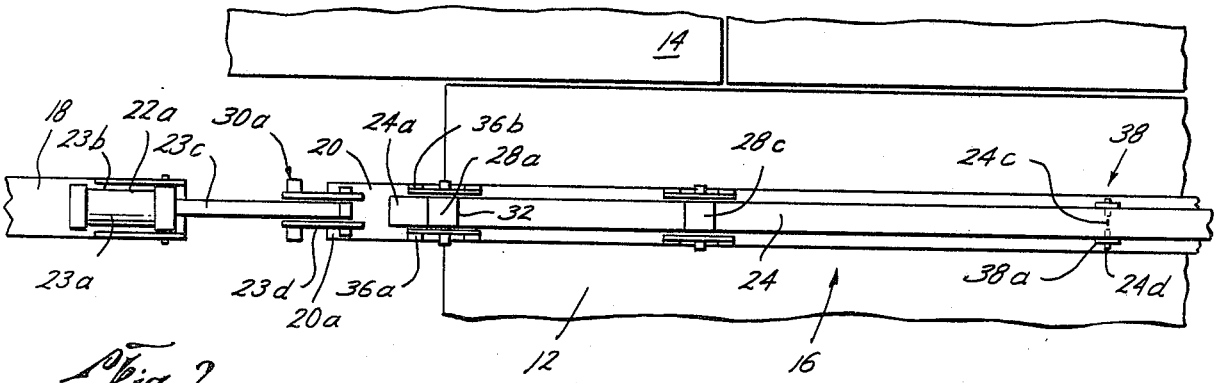
FIG. 2 is a top view of the wrapping machine taken along line 2—2 of FIG. 1.
Figure 1:
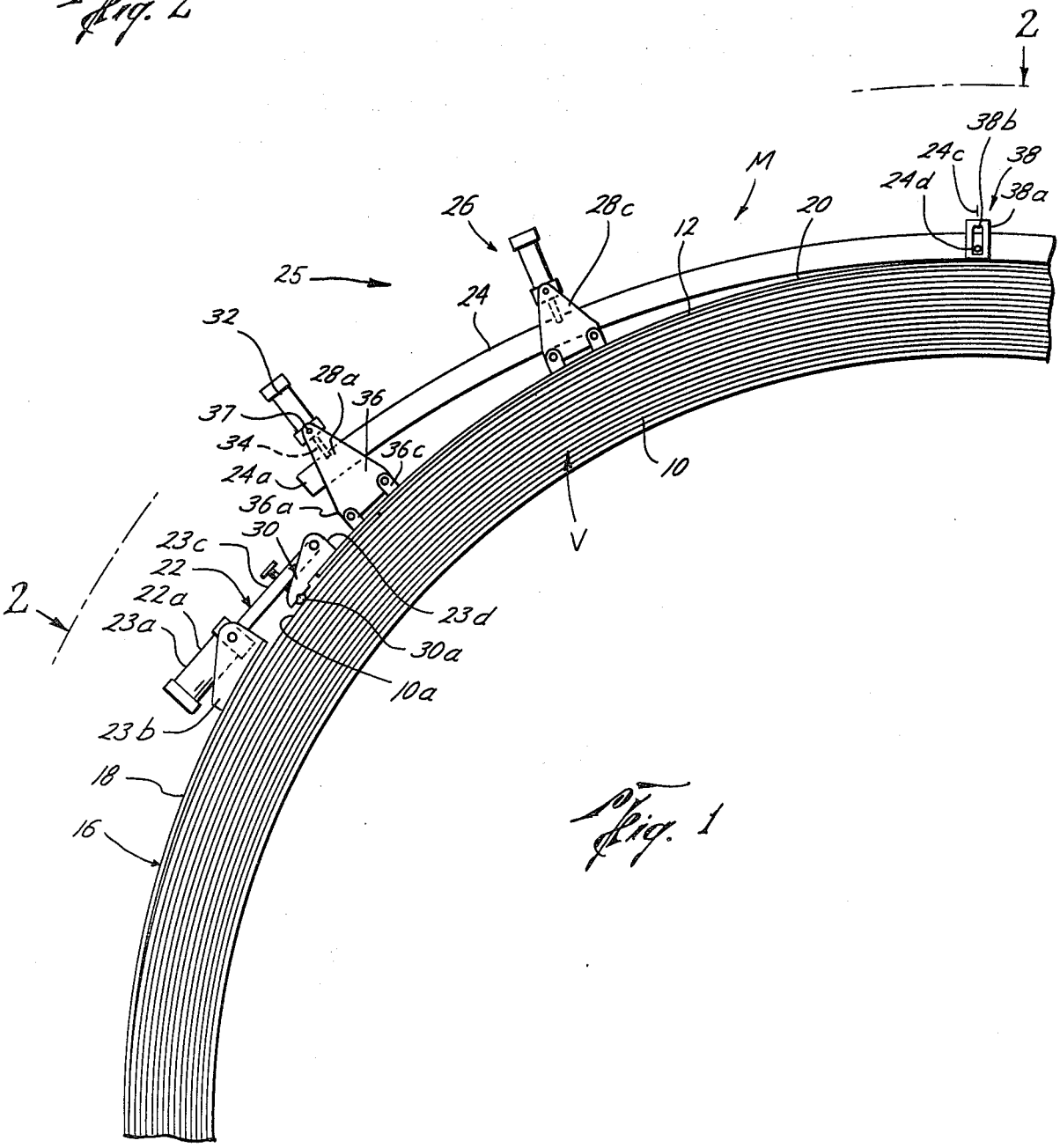
FIG. 1 is a plan view of a part of the wrapping machine of the present invention in position on a layered vessel being fabricated.

Referring to the drawings, FIG. 1 shows a detail of a portion of the wrapping machine M of the present invention mounted about a part of a partially completed layered vessel V. The layered vessel V is formed of a plurality of cylindrical layers 10. Each vessel layer 10 is formed from a plurality of welded vessel sections. For purposes of discussion here, the outermost inner layer which is at least completed in the partial view of the drawing here is designated 10*a*. A vessel section 12 is being added onto layer 10*a* of the vessel V and is to be welded to an adjacent longitudinal vessel section 14 shown in FIG. 2. In actual fabrication, the vessel section 12 being added is first tack-welded to inner layer 10*a* and after being fully positioned, it is finally welded to adjacent segments such as 14 in the same layer. The wrapping machine M of this invention is designed to position the vessel section 12 for tack-welding. As previously mentioned, it is necessary to position each vessel section being added as directly against the inner layer as possible so that a very tight fit is accomplished. Such a tight fit minimizes air space and allows the sections to be welded in the most effective pre-stressed positions.

The wrapping machine M includes a band means 16 that encircles the layered vessel V and the vessel section 12. The band means 16 has a first arcuate band portion 18 and a second arcuate band portion 20 which are joined by tensioning means 22 to form a generally circular band about the vessel 10 and the vessel section 12. Each band portion 18 and 20 is formed from a metal strip with a generally rectangular cross section.

The tensioning means 22 includes two hydraulic cylinder assemblies 22*a* and 22*b* which apply force through the application of fluid pressure to draw the first band portion 18 towards the second band portion 20. Each of the hydraulic cylinder assemblies 22*a* and 22*b* is positioned between and is attached to ends of the arcuate band portions 18 and 20.

Selective radial positioning means 25 is attached to the second band portion 20 for selectively placing all or only a part of the second band portion 20 in pressure engagement with the vessel section 12 in order to selectively press the vessel section 12 into radially directed engagement with the vessel layer 10*a*. The selective radial positioning means 25 includes a radial actuator bar 24 mounted above the second band portion 20 with a first end 24*a* and a second end 24*b*. A plurality of radial force means 26 are mounted with the radial actuator bar 24 for moving the second band portion 20 selectively toward and away from the radial actuator bar 24.

The radial force means 26 includes a plurality of hydraulic radially-directed actuator cylinder assemblies 28. The number of radial actuator cylinder assemblies 28 may vary; in the embodiment illustrated, there are four. A first radial actuator cylinder assembly 28*a* is mounted adjacent the first end 24*a* of the radial actuator bar 24 and a second radial actuator cylinder assembly 28*b* is mounted adjacent the second end 24*b* of the radial actuator bar 24. A third radial actuator cylinder assembly 28*c* is mounted between the first radial actuator cylinder assembly 28*a* and the middle 24*c* of the radial actuator bar 24 and a fourth radial actuator cylinder assembly 28*d* is mounted between the second radial actuated cylinder assembly 28b and the radial actuator bar middle 24c.

Each of the hydraulic cylinder assemblies 22a and 22b is identical except for location and includes a cylinder 23a pivotally mounted in a first bracket 23b joined to an end 18a of the first band portion 18. A piston member 23c is slidably mounted in the cylinder 23a and is pivotally mounted at its rod end to a second bracket 23d joined to the second band portion 20. The second bracket 23d is U-shaped and includes two plates mounted perpendicular to the second band portion 20. The piston member 23c is mounted between the two plates and is held by pins extending through the plates which allows limited rotational motion of the piston member 23c. The first bracket 23b is also U-shaped. When pressure is applied to the appropriate end of hydraulic cylinder assembly 22a or 22b, the piston member 23c is drawn into the cylinder 23a drawing the first band portion 18 towards the second band portion 20. The first and second band portions 18 and 20 together form less than a full circle.

To avoid damage to the vessel V outermost layer, an angular compensating means 30 is mounted to the tensioning means second bracket 23d. The angular compensation means 30 includes a roller 30a mounted to an end of second bracket 23d extending past the end of second band portion 20. The roller 30a is in contact with the adjacent layer 10a of the partially completed vessel V. Therefore when tensioning pressure is applied to the tensioning means 22, drawing band portion 18 towards second band portion 20, second band portion first and second ends 20a and 20b are held above the vessel V and will not gouge the vessel layer 10a.

Each radial actuator cylinder assembly 28a–d of the radial force means 26 comprises a cylinder 32, a piston member 34 and a mount 36. The cylinder 32 is attached by pins 37 to two parallel, spaced triangular plates 36a and 36b of the mount 36. The plates 36a and 36b are attached to four studs 36c extending from the second band portion 20. The piston member 34 is slidably, sealably mounted in cylinder 32 with its other end engaging radial actuator bar 24. When hydraulic pressure is directed into the appropriate end of radial actuator cylinder 32, the piston member 34 is extended from cylinder 32 which moves cylinder 32 away from the radial actuator bar 24 pulling plates 36a and 36b radially away and thus band 20 away from the section 12 and layer 10a of vessel V. This draws second band portion 20 away from vessel V toward radial actuator bar 24.

Mounted with the middle 20c of second band portion 20 is a guide means 38 which includes generally rectangular outward projecting flange portions 38a which are attached to the band 20 and have slots 38b formed therein. Projections 24d from radial actuator bar 24 extend through slots 38b to align the radial actuator bar 24 with the second band portion 20 adjacent bar middle 24c. This mounting means 38 also is used as a guide means to properly place the wrapping machine M in relation to the vessel section 12 to be applied.

METHOD OF APPLYING VESSEL SECTION

Figure 3:
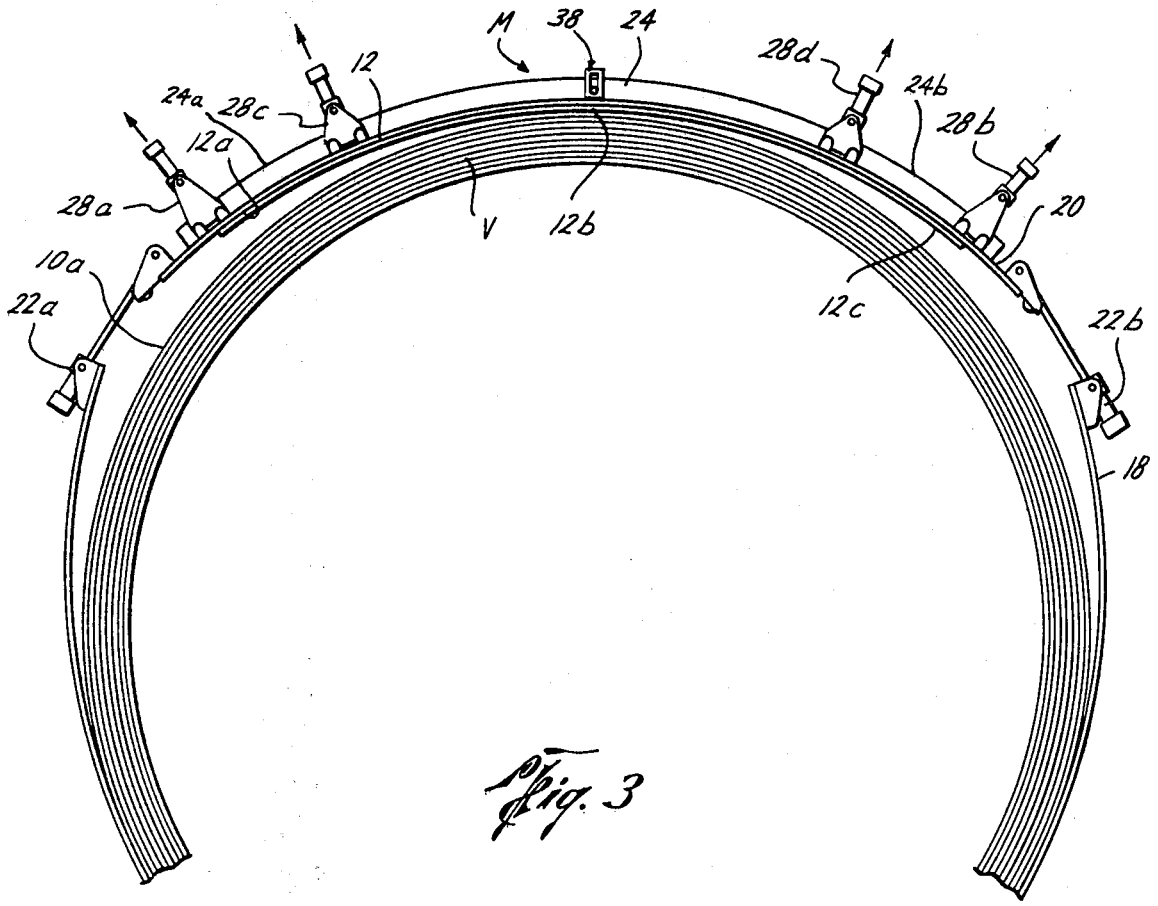
FIGS. 3–6 are plan views of successive stages of practicing the method of the present invention.

In operation, as seen in FIG. 3, the wrapping machine M is mounted about the vessel V with the second band portion 20 mounted over the vessel section 12 which has been placed in position on the inner vessel layer 10a. For convenience, the vessel layer section 12 being added will be referred to as having a lefthand portion 12a, a middle portion 12b and a righthand portion 12c.

Figure 4:
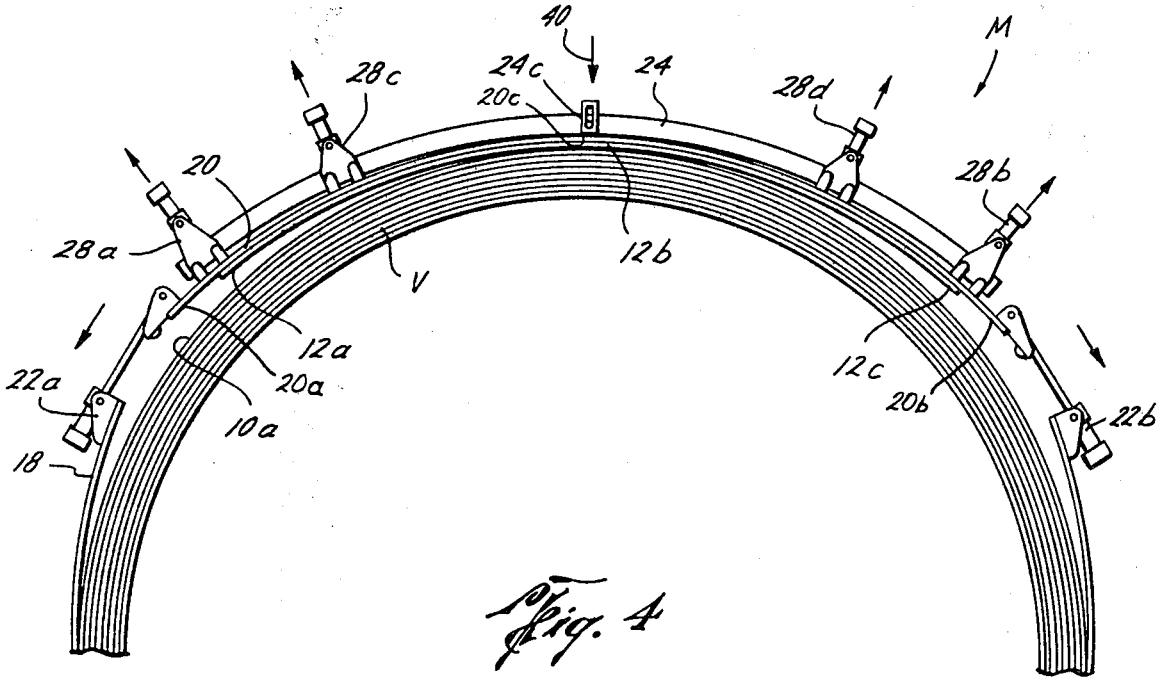

As a first step in the method of attaching the layer section 12, pressure is applied to the four radial positioning cylinder assemblies 28a–d drawing the second band portion 20 toward the radial actuator bar 24. As seen in FIG. 4, the second step is to apply hydraulic pressure to tensioning cylinder assemblies 22a and 22b drawing the second band portion 20 towards first band portion 18 and placing the entire band means 16 in tension. As a result of the forces created by the pressurization of the tensioning cylinder assemblies 22a and 22b and the position of radial positioning cylinder assemblies 28a–d, a force shown by force arrow 40 presses the radial actuator bar middle 24c radially inward into a pressure engaging position against the middle portion 12b of vessel section 12. Thereby the middle portion 12b is pressed radially against the vessel layer 10a.

Figure 5:
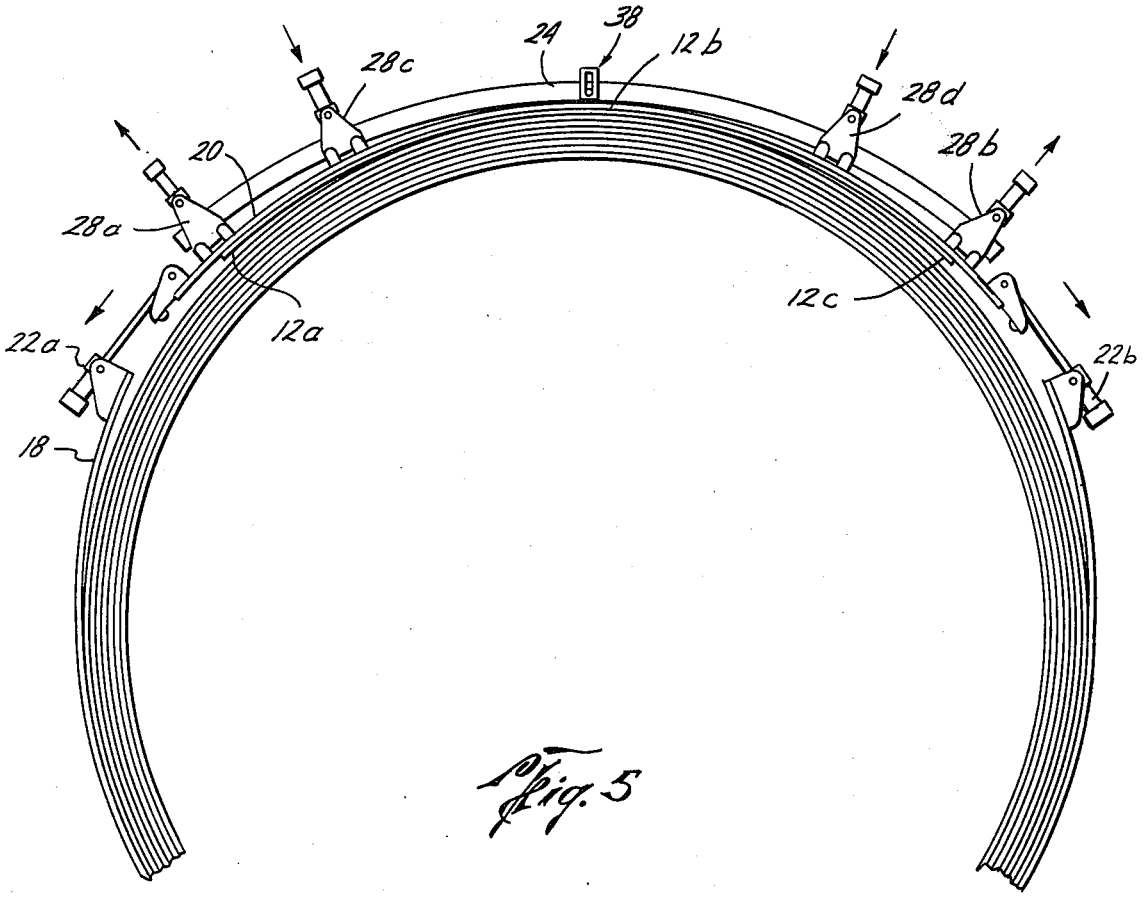

In the third step, shown in FIG. 5, while tension is held constant by tensioning cylinder assemblies 22a and 22b, the pressure in radial positioning cylinder assemblies 28c and 28d is released allowing a larger portion of the second band portion 20 to move inwardly toward vessel V to apply pressure against a larger part of the middle 12c of the vessel section 12 which is pressed radially against the vessel layer 10a.

Figure 6:
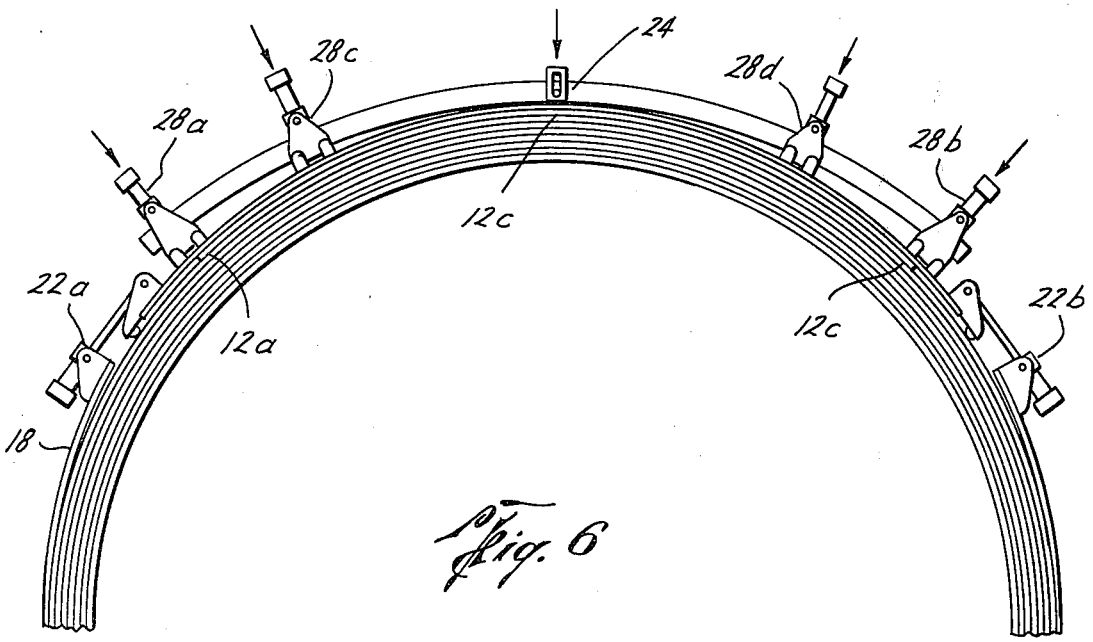

Immediately thereafter, in the fourth step, the pressure in radial positioning cylinder assemblies 28a and 28b is released as shown in FIG. 6, so the tensioning cylinder assemblies 22a and 22b force pulls second band portion 20 into engagement against the ends 12a and 12c of the vessel section 12 pressing all of the vessel section 12 radially against the inner vessel layer 10a. Because the forces applied to vessel section 12 are radial rather than tangential, beginning at the center and moving outward, there are only minimal frictional forces between the vessel section 12 and the vessel V. In addition because opposing tensioning cylinder assemblies 22a and 22b are used, any small tangential friction force is substantially cancelled.

After a vessel section 12 has been applied by the above method, if the vessel section 12 is not properly placed, selectively and sequentially applying pressure to opposite cylindrical assemblies 28 creates a rocking force which will selectively and sequentially position portions of the second band portion 20 so that the second band portion 20 selectively and sequentially presses portions of the vessel section 12 onto vessel layer 10a. This will cause proper seating of the vessel section 12. Otherwise, the section 12 is tack-welded as each portion is pressed against the inner layer 10a so that the section is pressed into direct radial engagement with layer 10a or, the entire section can be tack-welded after the section 12 is fully pressed into position.

Because the vessel V outer diameter will increase as additional layers 10 are added, the shell wrapping machine M may have band length adjustment means (not shown) to increase the length of first band portion 18.

The foregoing disclosure and description of the invention are illustrative and explanatory thereof, and various changes in the size, shape and materials as well as in the details of the illustrated construction may be made without departing from the spirit of the invention. For example, often times in such layered vessels, the innermost layer is substantially pre-formed as a liner and may even be of a different material. The wrapping machine M may be used to apply even the first vessel layer formed of sections to the liner.

I claim:

1. A wrapping machine used in constructing layered vessels having at least one layer formed of adjoining vessel sections which are welded onto an inner layer and to adjoining vessel sections only after being positioned and pressed into position by such wrapping machine, which comprises:

band means adapted to encircle the layered vessel for positioning and pressing a vessel section onto a vessel layer therebelow;

said band means having a first arcuate band portion and a second arcuate band portion, said first and said second band portions being joined by tensioning means for applying force to draw said first band portion towards said second band portion; and selective radial positioning means attached to said second band portion for selectively placing all or only a part of said second band in pressure engagement with said vessel section in order to selectively press said vessel section into radially directed engagement with such vessel layer therebelow.

2. The structure set forth in claim 1, wherein said selective radial positioning means includes:

a radial actuator bar mounted with said second band portion; and a plurality of radial force means mounted with said radial actuator bar for moving said second band portion selectively with respect to said radial actuator bar.

3. The structure of claim 2, wherein said radial force means includes:

a first radial actuator cylinder assembly mounted adjacent said first end of said radial actuator bar; and a second radial actuator cylinder assembly mounted adjacent said second end of said radial actuator bar.

4. The structure of claim 3, wherein said radial force means further includes:

a third radial actuator cylinder assembly mounted between said first radial actuator cylinder assembly and the middle of said radial actuator bar; and a fourth radial actuator cylinder assembly mounted between said second radial actuator cylinder assembly and the middle of said radial actuator bar.

5. The structure of claim 2, including:

guide means for aligning said second band portion with said radial actuator bar.

6. The structure of claim 1, including:

angular compensation means mounted with said tensioning means for protecting the inner layer of the vessel.

7. The structure of claim 1, wherein said tensioning means includes:

two hydraulic cylinder assemblies each positioned between and attached to an end of said first band portion and said second band portion;

each assembly having a cylinder pivotally mounted in a first bracket attached to said first band portion; and a piston slidably mounted in said cylinder with its rod end pivotally mounted to a second bracket attached to said second band portion.

8. The structure of claim 3, wherein said radial actuator cylinder assemblies include:

a cylinder mounted to two parallel plates extending from said second band portion; and a piston member slidably mounted in said cylinder with its other end engaging said radial actuator bar.

9. The structure of claim 1, wherein:

said first arcuate band portion and said second arcuate band portion together form less than a full circle.

* * * * *

UNITED STATES PATENT AND TRADEMARK OFFICE

CERTIFICATE OF CORRECTION

PATENT NO. : 4,418,560

DATED : December 6, 1983

INVENTOR(S) : Raymond E. Pechacek

It is certified that error appears in the above-identified patent and that said Letters Patent are hereby corrected as shown below:

In line 58 of Column 2, please delete "28." and insert therefor --28 a-d.--.

In line 59 of Column 2, please delete "28" and insert therefor --28 a-d--.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*